US005514252A

United States Patent [19]

Kerby, Jr. et al.

[11] Patent Number: 5,514,252

[45] Date of Patent: May 7, 1996

[54] METHOD FOR REDUCING CONRADSON CARBON CONTENT OF PETROLEUM STREAMS

[75] Inventors: Michael C. Kerby, Jr., Baton Rouge, La.; Mark A. Greaney, Upper Black Eddy, Pa.; Carl W. Hudson, Baton Rouge, La.

[73] Assignee: Exxon Research and Engineering Company, Florham Park, N.J.

[21] Appl. No.: 440,439

[22] Filed: May 12, 1995

Related U.S. Application Data

[63] Continuation-in-part of Ser. No. 365,380, Jan. 27, 1995, abandoned.

[51] Int. Cl.[6] ..... C25B 1/00

[52] U.S. Cl. ..... 205/696; 204/514; 204/559; 204/567

[58] Field of Search ..... 204/136, 188, 204/190

[56] References Cited

U.S. PATENT DOCUMENTS

| | | | |
|---|---|---|---|
| 3,344,045 | 2/1967 | Neikam | 204/59 |
| 3,401,101 | 9/1968 | Keller, Jr. | 204/136 |
| 3,915,819 | 10/1975 | Bell et al. | 204/136 |
| 4,187,156 | 2/1980 | Coleman et al. | 204/73 R |

FOREIGN PATENT DOCUMENTS

| | | | |
|---|---|---|---|
| 58-63785 | 4/1983 | Japan | 204/136 |

OTHER PUBLICATIONS

Danly, "Devel. of Commerc. of the Monsanto Electrochem. Adiponitrile Process," Ch. 7, pp. 147–164 in *Electrosyn. From Lab. To Pilot Prod.*, J. D. Genders and D. Fletcher, eds, publ. The Electrosyn. Co., E. Amherst, N.Y. (1990) * no month provided.

*Primary Examiner*—Arun S. Phasge
*Attorney, Agent, or Firm*—Linda M. Scuorzo

[57] ABSTRACT

The present invention provides a method for decreasing the Conradson carbon ("Concarbon") number of petroleum feedstreams by passing an electric current through a mixture of a petroleum stream, typically having a Conradson carbon residue of at least about 0.1% and an aqueous electrolysis medium at a pH and cathodic voltage for a time sufficient to decrease the Conradson carbon number of the petroleum stream. The electrolysis medium contains quaternary carbyl or hydrocarbyl onium salts; inorganic hydroxides such as NaOH or KOH, or mixtures thereof. A cathodic voltage of 0 V to −3.0 V vs. Saturated Calomel Electrode (SCE) and a pH of 6–14, preferably 7 to 14, more preferably above 7 to 14 are used.

The invention has utility for converting less economically desirable refinery feeds to feeds that are more valuable.

13 Claims, No Drawings

METHOD FOR REDUCING CONRADSON CARBON CONTENT OF PETROLEUM STREAMS

This is a Continuation-in-Part of U.S. Ser. No. 365,380 filed on Jan. 27, 1995 now abandoned.

FIELD OF THE INVENTION

The present invention relates to a method for electrochemically decreasing the Conradson Carbon content of refinery feedstreams.

BACKGROUND OF THE INVENTION

Conradson carbon ("Concarbon") number is a measure of the characteristic tendency of a petroleum feedstream to form coke during processing. Feedstreams having a lower Concarbon number are more economically desirable as refinery feeds than feedstreams having a higher concarbon number. It is, therefore, desirable to develop processes for reducing the Concarbon number of feedstreams. Applicants have developed such a process.

SUMMARY OF THE INVENTION

The present invention provides for a process for decreasing the Conradson carbon content of a petroleum stream, comprising passing an electric current through a mixture of a petroleum stream having a Conradson carbon residue, and an aqueous electrolysis medium at a pH and voltage and for a time sufficient to decrease the Conradson carbon number of the petroleum stream. The electrolysis medium contains an electrolyte which is water soluble. The Conradson carbon residue is typically at least about 0.1 wt %.

The present invention may suitably comprise, consist or consist essentially of the described elements and may be practiced in the absence an element not disclosed.

DETAILED DESCRIPTION OF THE INVENTION

The present invention provides a method for decreasing the Conradson carbon ("Concarbon") number or content of a petroleum fraction by subjecting an oil in water dispersion or mixture of a Conradson carbon containing petroleum fraction (also referred to herein as a stream or feed) and an aqueous electrolysis medium to an electric current at a pH and voltage and for a time sufficient to decrease the Conradson carbon number of the petroleum stream. The petroleum stream and aqueous electrolysis medium are contacted under conditions to result in passing of an electric current therethrough.

Conradson carbon number correlates with the coke residue forming propensity of petroleum streams. Petroleum streams having a high coke make typically have a deleterious effect on a number of petroleum refinery processes, such as fluid catalytic cracking, hydrotreating, coking, visbreaking, deasphalting and pipestill operations. In addition, coke is currently the lowest value refinery product, and thus generation of large quantities is not economically desirable. The higher the Concarbon number or residue the greater the number or size of the refinery units typically needed to process the resulting residue.

A wide variety of petroleum streams, including distillates thereof may be treated according to the process of the present invention to produce petroleum hydrocarbon fractions having a decreased Conradson carbon residue. The starting feedstocks are hydrocarbonaceous petroleum streams or fractions having a Conradson carbon residue, typically of at least about 0.1% by weight, and usually at least about 5% by weight. The process is applicable to distillates and other Conradson carbon containing product feeds resulting from various refinery processes, but is particularly effective when employed to treat heavy hydrocarbon feeds, e.g., those containing residual oils. Preferably, therefore, the process of the present invention is utilized for the treatment of whole or topped crude oils and residua having a Conradson carbon residue content. These include heavy oils, such as atmospheric residum (boiling above about 650° F., 343° C.) and vacuum residum (boiling above about 1050° F., 566° C.), heavy crudes, processed resides (bottoms) i.e., catalytic cracker bottoms, tars, e.g. steam cracker tars, distillation resides, deasphalted oils and resins and coker oils. Virgin crude oils obtained from any area of the world such as the Middle East as well as heavy gas oils, shale oils, tar sands or syncrude derived from tar sands, distillation resids, coal oils, asphaltenes and other heavy petroleum fractions and distillates thereof can be treated by the process of this invention.

The petroleum fraction contacted with the aqueous electrolysis medium should be liquid or fluid at process conditions. This may be accomplished by heating the material or by treatment with a suitable solvent as needed. This assists in maintaining the Conradson carbon residue-containing petroleum fraction and electrolysis medium in a fluid form to allow passage of an electric current. Current densities of 1 mA/cm$^2$ of cathode surface area or greater are suitable.

Preferably droplets should be of sufficient size to enable the Conradson carbon residue-containing components to achieve intimate contact with the electrolysis medium. Droplet size particles of about 0.1 micron to 1.0 mm, for example, are suitable.

Desirably the process should be carried out for a time and at conditions within the ranges disclosed sufficient to achieve a decrease, preferably a maximum decrease, in the Conradson carbon number or residue of the petroleum stream. Decreases of 3% Example 4 =3.8% or higher can be achieved, depending on the starting feed. Contacting is typically accomplished by intimate mixing of the petroleum stream and the aqueous electrolysis medium to form a mixture or an oil-in-water dispersion, for example using a stirred batch reactor or turbulence promoters in flowing cells.

Reaction temperatures will vary with the particular petroleum stream due to its viscosity, type of electrolyte and its pH. However, temperatures may suitably range from about ambient to about 700° F. (371° C.), preferably from 100° F. (38° C.) to 300° F. (149° C.), and pressures of from 0 atm (0 kPa) to 210 atm (21,200 kPa), preferably 1 atm (101 kPa) to 3 atm (303 kPa). Within the process conditions disclosed a liquid or fluid phase is maintained.

The electrolysis medium should desirably contain an electrolyte that dissolves or dissociates in water to produce electrically conducting ions, but that does not undergo redox in the range of applied potentials used. Organic electrolytes include quaternary carbyl and hydrocarbyl onium salts e.g., alkylammonium hydroxides and tetrabutyl ammonium toluene sulfonate. Inorganic electrolytes include NaOH, KOH and sodium phosphate. Mixtures thereof also may be used. Suitable onium ions include mono- and bisphosphonium, sulfonium and ammonium, preferably ammonium ions. Carbyl and hydrocarbyl moieties are preferably alkyl. Quaternary alkyl ammonium ions include tetrabutyl and tetraethyl ammonium. Optionally, additives known in the art to enhance performance of the electrodes or the system may be added such as surfactants, detergents, anodic depolarizing agents and emulsifying agents. Basic electrolytes are most preferred. With organic electrolytes, length and degree of branching of the carbyl or hydrocarbyl moieties influences the degree of oil or water solubility. The concentration of salt in the electrolysis medium should be sufficient to generate an electrically conducting solution in the presence of the petroleum component. Typically a concentration of electrolyte salt in the aqueous electrolysis medium is 1–50 wt %, preferably 5–25 wt % is suitable.

Within the process conditions disclosed the pH of the aqueous electrolysis medium can vary from 6 to 14, preferably 7 to 13 or 7 to 14, most preferably from above 7 to 13, or from above 7 to 14.

It is possible to carry out the process either in air or under inert atmosphere. A benefit to the present invention is that the process may be operated under ambient temperature and atmospheric pressure, although higher temperature and pressures also may be used as needed.

In its most basic form the process is carried out in an electrochemical cell by electrolytic means, i.e., in a non-electrostatic mode, as passage of electric current through the mixture or dispersion is required (e.g., relatively low voltage, high current). The cell may be either divided or undivided. Such systems include stirred batch or flow through reactors. The foregoing may be purchased commercially or made using technology known in the art. Suitable electrodes are known in the art. The cathodic voltage is in the range of 0 to −3.0 V versus Saturated Calomel Electrode (SCE), preferably −1.0 to −2.5 V vs. SCE based on the characteristics of the particular petroleum fraction. While direct current is typically used, electrode performance may be enhanced using alternating current or other voltage/current waveforms.

The present invention is demonstrated with reference to the following non-limiting examples.

The Conradson carbon content was determined using the microcarbon residue (MCR) method, ASTM D-4530-85. According to ASTM D 4530-85, MCR is equivalent to Conradson carbon.

EXAMPLE 1

Conradson Carbon Removal from Bitumen

The electrochemical cell used in this study was a commercially available coulometry cell (Princeton Applied Research) consisting of a mercury pool cathode, a platinum wire anode, a saturated calomel reference electrode, and a glass stirring paddle. A Cold Lake bitumen (10 mL) and an aqueous solution of 40 wt % tetrabutyl ammonium hydroxide (20 mL) was added to the electrochemical cell. The solution was purged under nitrogen (1 atm). The applied potential was set at −2.8 V vs. SCE and the solution stirred. After 6 h the stirring was stopped and the aqueous bitumen mixture was allowed to separate. The treated bitumen was removed, dried over magnesium sulfate, stripped of toluene and analyzed.

| | Feed | Product |
|---|---|---|
| MCR | 15.4 | 10.5 |

EXAMPLE 2

Conradson Carbon Removal from Light Arab Atmospheric Resid

The same equipment as used in example 1 was employed here. A 1.7 g sample of light Arab atmospheric resid was diluted with 10 mL toluene and added to an aqueous solution of 40 wt % tetra-butyl ammonium hydroxide (20 mL) in the electrochemical cell. The solution was purged under nitrogen (1 atm). The applied potential was set at −2.5 V vs. SCE and the solution stirred. After 18 h the stirring was stopped and the aqueous/resid mixture was allowed to separate. The treated resid was removed, dried over magnesium sulfate, stripped of toluene and analyzed as above.

| | Starting Feed | Product |
|---|---|---|
| MCR | 10.2 | 6.8 |

EXAMPLE 3

Conradson Carbon Removal from Fluid Cat Cracker Bottoms

The same equipment as used in example 1 was employed here. A 5.4 g sample of catalytic cracker bottoms was diluted with 10 mL toluene and added to an aqueous solution of 40 wt % tetra-butyl ammonium hydroxide (20 mL) in the electrochemical cell. The solution was purged under nitrogen (1 atm). The applied potential was set at −2.0 V vs. SCE and the solution stirred. After 6 h the stirring was stopped and the aqueous/organic mixture was allowed to separate. The treated catalytic cracker bottom was removed, dried over magnesium sulfate, stripped of toluene and analyzed as above.

| | Starting Feed | Product |
|---|---|---|
| MCR | 14.4 | 7.1 |

EXAMPLE 4

Conradson Carbon Removal from South Louisiana Vacuum Resid in a Flowing Electrochemical Cell 100 g of South Louisiana vacuum resid was fluxed with 100 ml toluene, and then mixed with 100 ml of an aqueous mixture of 10 wt % sodium hydroxide and 5 wt % tetrabutyl ammonium hydroxide. This solution was stirred vigorously, heated to 60° C. and then passed through a commercially available flowing electrochemical cell (FM01-LC Electrolyzer built by ICI Polymers and Chemicals). In this cell the solution passes through an interelectrode gap between two flat plate electrodes. The cathode in this case was lead and the anode was stainless steel. The mixture was continuously recirculated through this cell during which time a controlled current of 1.5 amps was applied. After this, the solution was allowed to separate. The treated resid was removed, dried over magnesium sulfate, stripped of toluene and analyzed as above.

| | Starting Feed | Product |
|---|---|---|
| MCR | 13.1 | 12.6 |

What is claimed is:

1. A process for decreasing the Conradson content of a petroleum stream, comprising: subjecting a mixture of a petroleum stream having a Conradson carbon content and an aqueous electrolysis medium to an electric current at a pH and for a time sufficient to decrease the Conradson carbon number of the petroleum stream.

2. The process of claim 1 wherein the Conradson carbon content is at least about 0.1%.

3. The process of claim 1 wherein the electric current is at a cathodic voltage of from 0 to −3.0 V vs. SCE.

4. The process of claim 1 wherein the aqueous electrolysis medium contains an electrolyte selected from the group consisting of inorganic salts, organic salts and mixtures thereof.

5. The process of claim 1 wherein the petroleum stream is selected from the group consisting of crude oils, distillation resides, coker oils, bitumen, catalytic cracker bottoms, distillation resides, steam cracker tars, deasphalted oils, visbreaker bottoms, residfiner products.

6. The process of claim 1 wherein the pH is from 6 to 14.

7. The process of claim 1 wherein the pH is from 7 to 14.

8. The process of claim 1 wherein the pH is from above 7 to 14.

9. The process of claim 1 wherein the cathodic voltage is from −1.0 to −2.5 V vs. SCE.

10. The process of claim 1 wherein the pressure is from about 0 atm (0 kPa) to about 210 atm (21,200 kPa).

11. The process of claim 1 wherein the temperature is from ambient to 700° F. (371°).

12. The process of claim 1 wherein the concentration of the electrolyte in the aqueous electrolysis medium is from 1 to 50 wt %.

13. The process of claim 1 wherein the mixture is an oil in water dispersion.

* * * * *